US006959758B2

(12) United States Patent
Hughes et al.

(10) Patent No.: US 6,959,758 B2
(45) Date of Patent: Nov. 1, 2005

(54) SERPENTINE TUBE, CROSS FLOW HEAT EXCHANGER CONSTRUCTION

(75) Inventors: Gregory Hughes, Milwaukee, WI (US); Stephen Memory, Kenosha, WI (US)

(73) Assignee: Modine Manufacturing Company, Racine, WI (US)

( * ) Notice: Subject to any disclaimer, the term of this patent is extended or adjusted under 35 U.S.C. 154(b) by 96 days.

(21) Appl. No.: 10/308,304

(22) Filed: Dec. 3, 2002

(65) Prior Publication Data

US 2004/0104018 A1 Jun. 3, 2004

(51) Int. Cl.[7] ..... F28D 7/08; F28D 7/16
(52) U.S. Cl. ..... 165/165; 165/150
(58) Field of Search ..... 165/164, 165, 165/140; 62/513

(56) References Cited

U.S. PATENT DOCUMENTS

| | | | | |
|---|---|---|---|---|
| 1,720,768 A | * | 7/1929 | Spreen | 62/406 |
| 4,587,701 A | | 5/1986 | Koisuka et al. | |
| 4,602,674 A | | 7/1986 | Eriksson | |
| 4,747,450 A | | 5/1988 | Ikegame et al. | |
| 4,942,654 A | | 7/1990 | Wright et al. | |
| 5,036,909 A | | 8/1991 | Whitehead et al. | |
| 5,704,123 A | | 1/1998 | Paulman et al. | |
| 5,875,837 A | * | 3/1999 | Hughes | 165/140 |
| 5,964,284 A | | 10/1999 | Ikejima et al. | |
| 6,212,764 B1 | | 4/2001 | Schornhorst et al. | |

FOREIGN PATENT DOCUMENTS

JP 2001174083 6/2001

* cited by examiner

*Primary Examiner*—Allen J. Flanigan
(74) *Attorney, Agent, or Firm*—Wood, Phillips, Katz, Clark & Mortimer

(57) ABSTRACT

A heat exchanger (10) is provided to transfer heat between a first and second fluid flow. The heat exchanger 10 includes a flow path (20) provided in the form of one or more heat exchange tubes (40, 40A–C), and a second flow path (30) provided in the form of one or more serpentine heat exchange tubes (42, 42A–C). The tube(s) (40, 40A–C) is (are) "woven" together with the tube(s) (42, 42A–C) such that they are perpendicular to each other. The heat exchanger (10) can provide particular advantages when used as a suction line heat exchanger in a transcritical cooling system (12).

8 Claims, 3 Drawing Sheets

SERPENTINE TUBE, CROSS FLOW HEAT EXCHANGER CONSTRUCTION

FIELD OF THE INVENTION

This invention relates to heat exchangers, and more particularly, to heat exchangers utilizing serpentine tubes and to suction line heat exchangers for use in air conditioning/refrigeration systems.

BACKGROUND OF THE INVENTION

As is known, discharge into the atmosphere of certain refrigerants, such as those that contain fluorocarbons, is considered to be undesirable for the environment in that they may contribute to the so-called green house effect and/or the degradation of the ozone layer. Fluorocarbons containing refrigerants have often been used in vehicular applications where weight and size are substantial concerns. However, this results in leakage of the undesirable refrigerant to the atmosphere in many vehicular air conditioning systems because such systems typically employ a compressor that requires rotary power by a belt or the like from the engine of the vehicle and as a result can not be hermetically sealed, as in stationary systems. Accordingly, it would be desirable to provide a refrigeration system for use in vehicular applications where any refrigerant that escapes to the atmosphere would not be as potentially damaging to the environment as the refrigerants currently employed, and wherein the components of the refrigeration system remain relatively small and lightweight so as to minimize any adverse consequences on fuel economy for the vehicle.

One type of system considered for vehicular applications is a transcritical carbon dioxide ($CO_2$) system. One benefit of such systems is that the $CO_2$ utilized as a refrigerant can initially be claimed from the atmosphere, so that if it eventually leaks from the system, there is no net increase in atmospheric $CO_2$ content. Further, while $CO_2$ can be undesirable from the standpoint of the greenhouse effect, it does not affect the ozone layer and its use as a refrigerant should not cause an increase in the greenhouse affect since, as just mentioned, there will be no net increase in atmospheric $CO_2$ as a result of leakage.

In transcritical $CO_2$ air conditioning systems, it is often desirable to employ a so-called "suction line heat exchanger" to increase the effectiveness of the transcritical cycle by transferring heat from the refrigerant on the high pressure side of the system to the refrigerant on the low pressure side of the system. However, the addition of a suction line heat exchanger to the vehicle has the potential for increasing weight, as well as consuming more of the space allocated for the air conditioning system in the vehicle. Accordingly, there is a need for a relatively compact and lightweight suction line heat exchanger.

SUMMARY OF THE INVENTION

It is the principle object of the invention to provide a new and improved heat exchanger construction.

It is another object of the invention to provide an improved heat exchanger construction that can be utilized for a suction line heat exchanger in a transcritical cooling system, particularly in a transcritical cooling system for a vehicle.

At least some of these objectives are realized in a heat exchanger for transferring heat between first and second fluids. The heat exchanger includes a first flattened heat exchange tube to direct the first fluid through the heat exchanger, and a second flattened heat exchange tube to direct the second fluid through the heat exchanger. The first tube includes at least a first pair of substantially parallel, spaced tube runs connected by a bend in the first tube. The second tube includes at least three substantially parallel, spaced tube runs connected by bends in the second tube. The tube runs of the second tube are substantially perpendicular to the first pair of tube runs of the first tube. One of the tube runs of the second tube is sandwiched between the tube runs of the first pair of tube runs. One of the tube runs of the first pair of tube runs is sandwiched between the one of the tube runs of the second tube and another of the tube runs of the second tube, and the other of the tube runs of the first pair of tube runs is sandwiched between another of the tube runs of the second tube and the one of the tube runs of the second tube that is sandwiched between the tube runs of the first pair of tube runs.

In one form, a first pair of manifolds are connected to opposite ends of the first tube to distribute the first fluid to and collect the first fluid from the first tube, and a second pair of manifolds are connected to opposite ends of the second tube to distribute the second fluid to and to collect the second fluid from the second tube.

In accordance with another aspect of the invention, a heat exchanger is provided for use in a transcritical cooling system including a compressor, a gas cooler that receives a high pressure refrigerant flow from the compressor and delivers a cooled high pressure refrigerant to the system, an expansion device that receives the high pressure refrigerant flow from the gas cooler and delivers a low pressure refrigerant flow to the system, and an evaporator that receives the low pressure refrigerant flow and delivers heated low pressure refrigerant to the system. The heat exchanger includes a first flattened heat exchange tube to direct the high pressure working fluid through the heat exchanger, and a second flattened heat exchange tube to direct the low pressure working fluid through the heat exchanger. The first tube includes at least a first pair of substantially parallel, spaced tube runs connected by a bend in the first tube. The second tube includes at least three substantially parallel, spaced tube runs connected by bends in the second tube. The tube runs of the second tube are substantially perpendicular to the first pair of tube runs. One of the tube runs of the second tube is sandwiched between the tube runs of the first pair of tube runs. One of the tube runs of the first pair of tube runs is sandwiched between the one of the tube runs of the second tube and another of the tube runs of the second tube, and the other of the tube runs of the first pair of tube runs is sandwiched between another of the tube runs of the second tube and the one of the tube runs of the second tube.

According to one aspect of invention, a heat exchanger is provided for transferring heat between first and second fluids. The heat exchanger includes a plurality of flattened, first heat exchange tubes to direct the first fluid through the heat exchanger, and a plurality of flattened, second heat exchange tubes to direct the second fluid through the heat exchanger. Each of the first tubes includes at least a first pair of substantially parallel, spaced tube runs connected by a bend in the first tube. The first pairs of be runs are substantially aligned with each other. Each of the second tubes include at least a second pair of substantially parallel, spaced tube runs connected by a bend in the second tube. The second pairs of tube runs are substantially aligned with each other and substantially perpendicular to the first pair of tube runs. One of the tube runs of each of the second tubes is sandwiched between the tube runs of each first pair of tube runs of the first tubes. One of the tube runs of each of the first tubes is sandwiched between the tube runs of each second pair of tube runs of the second tubes.

In one form, each of the second tubes include an additional tube run substantially parallel to the second pair of tube runs of the second tube and connected to the one of the tube runs of the second tube by an additional bend. The other of the tube runs of each of the first tubes is sandwiched between the additional tube run of each of the second tubes and the one of the tube runs of each of the second tubes.

In one form, the heat exchanger further includes a first pair of manifolds connected to opposite ends of each of the first tubes which distribute the first fluid to and collect the first fluid from the first tubes. A second pair of manifolds are connected to opposite ends of each of the second tubes to distribute the second fluid to and collect the second fluid from the second tubes.

In one aspect, a heat exchanger is provided for transferring heat between first and second fluids. The heat exchanger includes a plurality of first heat exchange tubes to direct the first fluid through the heat exchanger, and a plurality of second heat exchange tubes to direct the second fluid through the heat exchanger. Each first tube includes at least a first pair of substantially parallel, spaced tube runs connected by a bend in the tube. The first pairs of tube runs are substantially aligned with each other. Each second tube includes at least three substantially parallel, spaced tube runs connected by bends in the second tubes. The tube runs of each of the second tubes are substantially aligned with the tube runs of the other of the second tubes and substantially perpendicular to the first pair of tube runs. One of the tube runs of each of the second tubes is sandwiched between the tube runs of each first pair of tube runs of the first tubes. One of the tube runs of each of the first tubes is sandwiched between the one of the tube runs of each of the second tubes and another of the tube runs of each of the second tubes, and the other of the tube runs of each of the first tubes is sandwiched between another of the tube runs of each of the second tubes and the one of the tube runs of each of the second tubes.

Other objects and advantages of the invention will become apparent upon further review of the specification, including the appended claims and drawings.

DETAILED DESCRIPTION OF THE PREFERRED EMBODIMENT

Several embodiments of a heat exchanger 10 embodying the present invention are shown and/or described herein in connection with a transcritical cooling system 12. While the heat exchanger 10 can provide certain benefits when employed as a suction line heat exchanger in a transcritical cooling system 12 to transfer heat from the high pressure refrigerant to the low pressure refrigerant, it should be understood that the heat exchanger 10 may find use in other types of systems for transferring heat between other types of fluids. Accordingly, no limitation to use with a transcritical cooling system or with refrigerant is intended, unless expressly recited in the claims.

Figure 1:
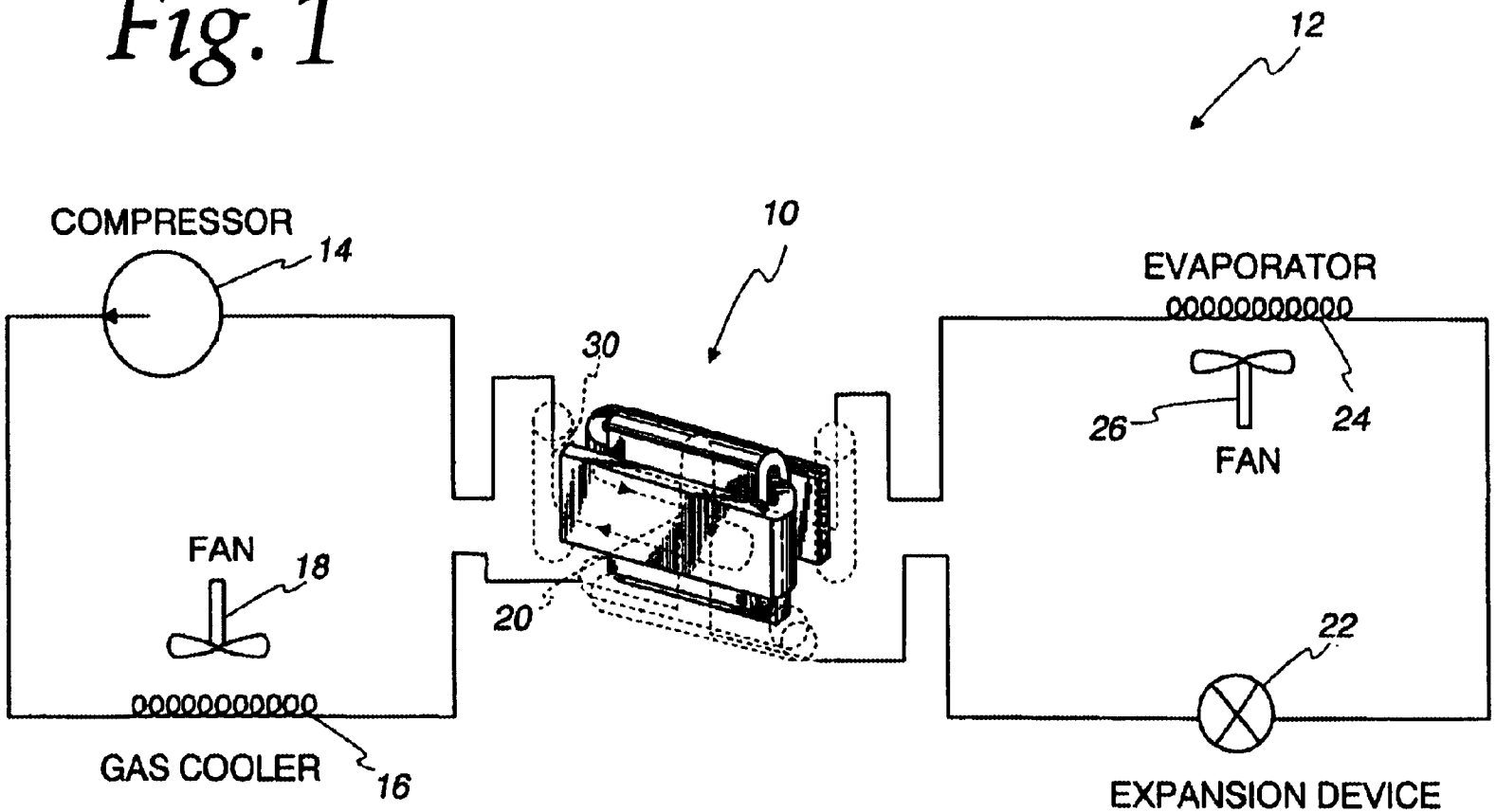
FIG. 1 is a diagrammatic representation of a transcritical cooling system including a heat exchanger embodying the present invention.

As seen in FIG. 1, the transcritical cooling system 12 includes a compressor 14 that receives vapor phase $CO_2$ refrigerant and compresses the same for delivery of a high pressure refrigerant flow to a gas cooler 16. Typically, but not always, the gas cooler 16 will be cooled by ambient air directed through it by a fan 18 and/or by forward motion of a vehicle in which the system is mounted. As a result, hot liquid and/or dense gaseous refrigerant exits the gas cooler 16 and is provided to a high pressure flow path 20 of the suction line heat exchanger 10 and then to an expansion device 22. The expansion device 22 expands the high pressure refrigerant flow to provide a cooled, low pressure refrigerant flow to an evaporator 24. Typically, but not always, ambient air is directed through the evaporator by a fan 26 so that the heat from the air can be rejected to the low pressure refrigerant flow through the evaporator 22. However, in some instances, the evaporator may be employed to cool a fluid other than air. The heated, low pressure refrigerant then flows through a low pressure flow path 30 of the heat exchanger 10 wherein heat is rejected from the refrigerant in the high pressure flow path 20 to the low pressure refrigerant in the low pressure flow path 30. Preferably, the heat transfer is such that the low pressure refrigerant emerges from the heat exchanger 10 as a super heated vapor that then flows to the compressor 14 to complete the cycle.

With reference to FIGS. 2 and 3–5, two embodiments of the heat exchanger 10 are shown. In the embodiment shown in FIG. 2, the high pressure flow path 20 is provided in the form of a single, flattened serpentine heat exchange tube 40 and the low pressure flow path 30 is provided in the form of a single, flattened serpentine heat exchange tube 42. Alternatively, in the embodiment of the heat exchanger 10 shown in FIGS. 3–5, the high pressure flow path 20 is provided in the form of three (3) of flattened, serpentine heat exchange tubes 40A, 40B, 40C, and the low pressure flow path 30 is provided in the form of three flattened, serpentine heat exchange tubes 42A, 42B and 42C. It can be seen from FIGS. 2–5, that the tube(s) 40, 40A–C is (are) "woven" together with the tube(s) 42, 42A–C such that they are perpendicular to each other. Accordingly, the heat exchanger 10 provides a cross flow arrangement for the refrigerant Each of the flattened tubes 40, 40A–C, 42, 42A–C includes opposed, long flat sides 44 and short sides or rounded edges 46 which extend across the minor dimension of the tube. A plurality of ports or micro channels 48 are provided in each of the tubes separated by webs 49. Typically, the tubes will be formed by extrusion, with the tubes 40 and 42 being large major extrusions and the tubes 40A–C and 42A–C being smaller major extrusions. However, it should be appreciated that the tubes could also be fabricated, i.e. a flattened tube with an interior insert brazed to the interior walls to define the multiple ports 49.

Figure 2:
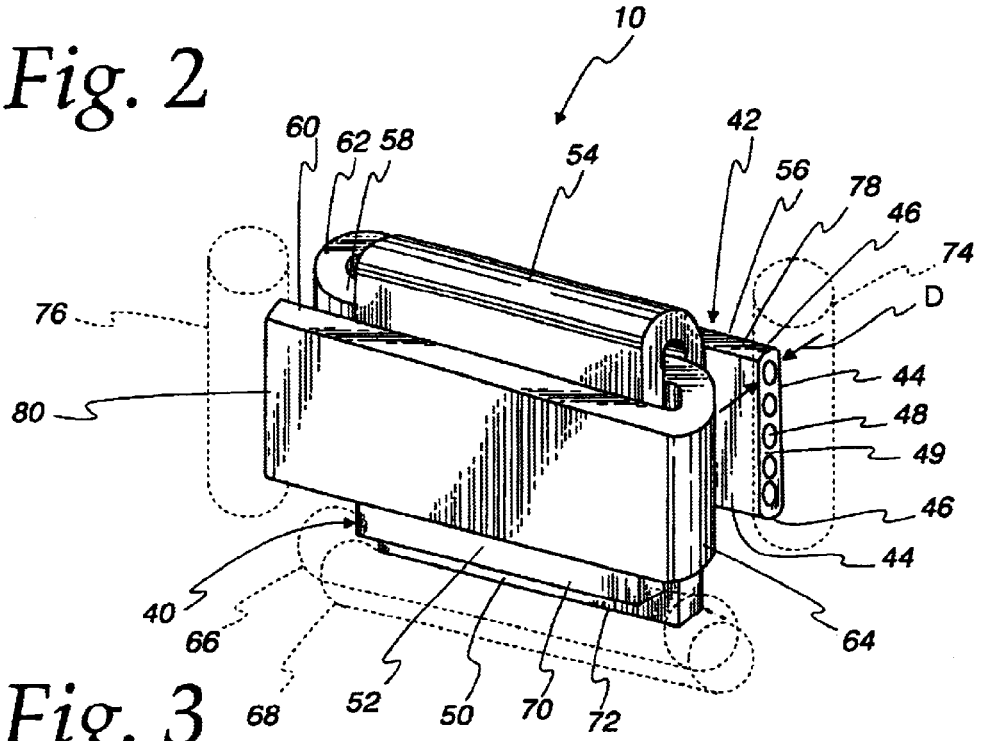
FIG. 2 is a somewhat diagrammatic perspective view of the heat exchanger shown in FIG. 1.

Turning now specifically to FIG. 2, it can be seen that the tube 40 includes a pair of substantially parallel, spaced tube runs 50 and 52 connected by a bend 54 in the tube 40. The tube 42 includes three substantially parallel, spaced tube runs 56, 58, and 60, with the tube runs 56 and 58 connected by a bend at 62 and the tube runs 58 and 60 connected by a bend 64. The tube runs 56, 58, and 60 of the tube 42 are substantially perpendicular to the tube runs 50 and 52 of the first tube 40.

The tube run 50 of the tube 40 is sandwiched between the tube runs 56 and 58 of the tube 42, with the flat sides 44 of the tube run 50 abutting one of the flat sides 44 of the tube run 56 and one of the flat sides 44 of the tube run 58 in the areas of engagement. Similarly, the tube run 52 of the tube 40 is sandwiched between the tube runs 58 and 60 of the tube 42, with the flat sides 44 of the tube run 52 abutting one of the flat sides 44 of the tube run 58 and one of the flat sides 44 of the tube run 60 in the areas of engagement. It follows that the tube run 58 of the tube 42 is sandwiched between the tube runs 50 and 52 of the tube 40, again with the flat sides 44 of the tube run 58 abutting one of the flat sides 44 of the tube run 50 and one of the flat sides 44 of the tube run 52 in the areas of engagement.

Preferably, a pair of cylindrical manifolds 66 and 68 are provided at each end 70 and 72 of the tube 40, and a pair of cylindrical headers 74 and 76 are provided at each end 78 and 80 of the tube 42. Preferably, the header 66 is an inlet header that receives the high pressure refrigerant from the system 10 to distribute it to the tube 40 and the header 68 is an exit header that collects the high pressure refrigerant from the tube 40 and delivers it back to the system 12, and the header 74 is an inlet header that receives the low pressure refrigerant flow from the system 12 and distributes the low pressure refrigerant flow to the tube 42, and the header 76 is an exit header that collects the low pressure refrigerant from the tube 42 and delivers it back to the system 12. This configuration provides a desired cross-counter flow arrangement for the low and high pressure refrigerant flows of the system 12.

Figure 3:
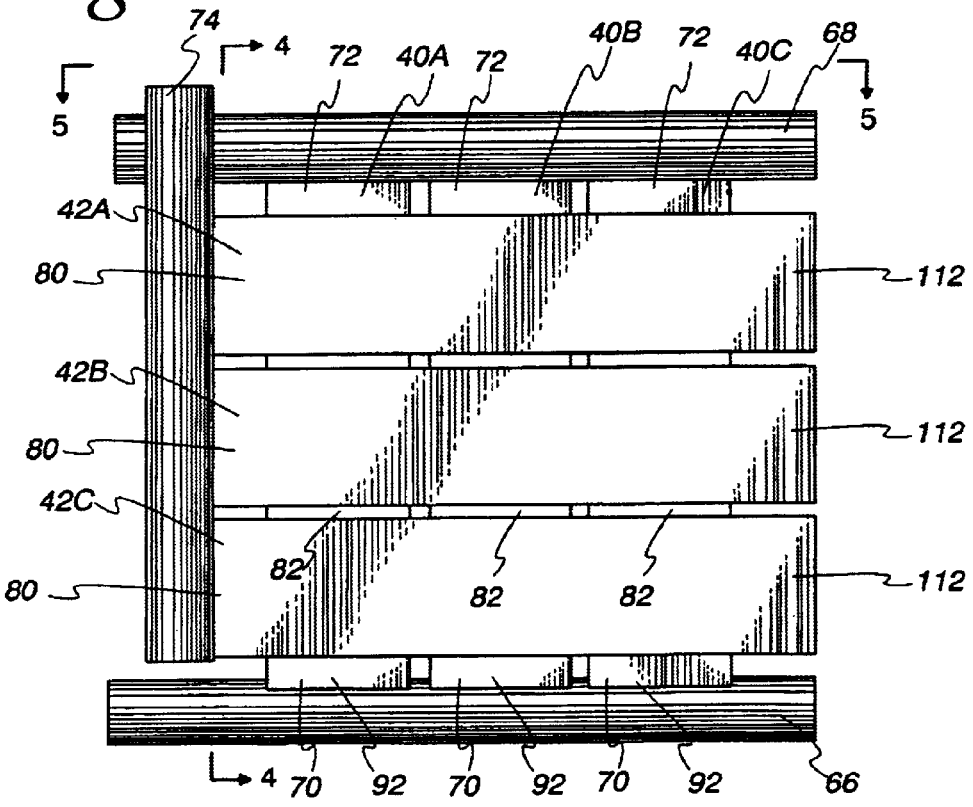
FIG. 3 is an elevation view of another embodiment of a heat exchanger according to the invention.
Figure 4:
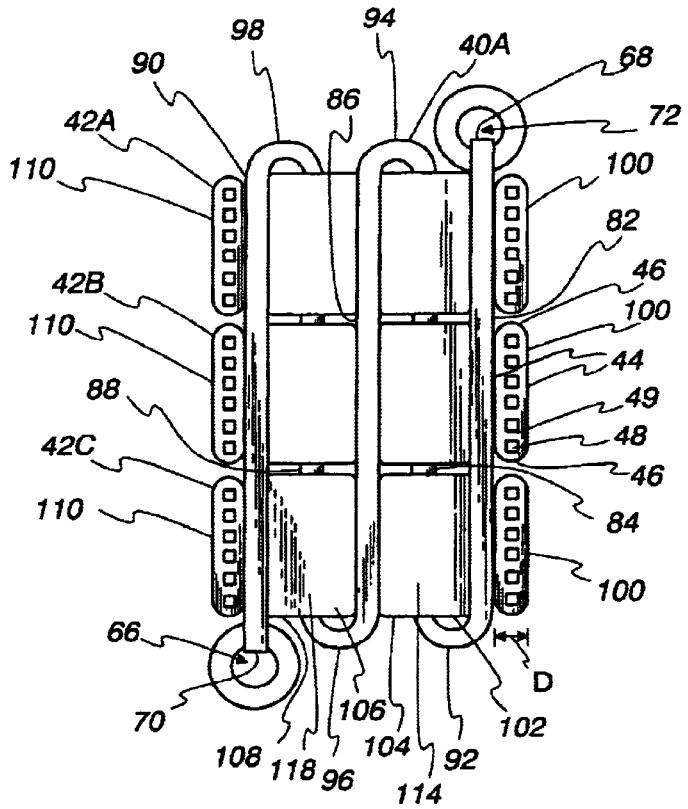
FIG. 4 is a view taken from line 4—4 in FIG. 3.
Figure 5:
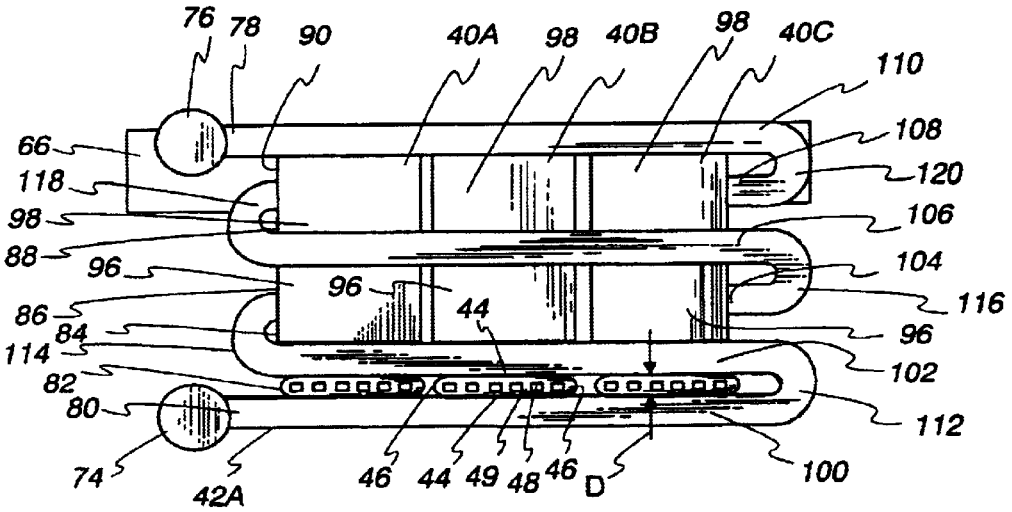
FIG. 5 is a view taken from line 5—5 in FIG. 3, with a manifold of the heat exchanger not shown.

Turning now to the embodiment of the heat exchanger 10 shown in FIGS. 3–5, it can be seen that each of the tubes 40A–C includes five parallel, spaced tube runs 82, 84, 86, 88, and 90 with the tube runs 82 and 84 connected by a bend 92, the tube runs 84 and 86 connected by a bend 94, the tube runs 86 and 88 connected by a bend 96, and the tube runs 88 and 90 connected by a bend 98, as best seen in FIG. 4. As best seen in FIG. 5, each of the tubes 42A–C includes six tube runs 100, 102, 104, 106, 108 and 110, with the tube runs 100 and 102 connected by a bend 112, the tube runs 102 and 104 connected by a bend 114, the tube runs 104 and 106 connected by a bend 116, the tube runs 106 and 108 connected by a bend 118 and the tube runs 108 and 110 connected by a bend 120. For each of the tubes 40A–C, the tube run 82 is sandwiched by tube runs 100 and 102 of the tubes 42A–C, the tube run 84 is sandwiched by the tube runs 102 and 104 of the tubes 42A–C, the tube run 86 is sandwiched by the tube runs 104 and 106 of the tubes 42A–C, the tube run 88 is sandwiched by the tube runs 106 and 108 of the tubes 42A–C, and the tube run 90 is sandwiched by the tube runs 108 and 110 of the tubes 42A–C, again with the respective flat sides 44 abutting each other in the areas of engagement. It follows that for each of the tubes 42A–C, the tube run 102 is sandwiched by the tube runs 82 and 84 of the tubes 40A–C, the tube run 104 is sandwiched by the tube runs 84 and 86 of the tubes 40A–C, the tube run 106 is sandwiched by the tube runs 86 and 88 of the tubes 40A–C, and the tube run 108 is sandwiched by the tube runs 88 and 90 the tubes 40A–C, again with the flat sides 44 of the respective tubes abutting each other in the areas of engagement. As with the embodiment shown in FIG. 2, it is preferred that the embodiment of the heat exchanger 10 shown in FIGS. 3–5 include a pair of headers 66 and 68 connected to the opposite ends 70 and 72 of the tubes 40A–C, and a pair of headers 74 and 76 connected to the ends 78 and 80 of the tubes 42A–C. Again, as with the embodiment shown in FIG. 2, it is preferred that for the embodiment of the heat exchanger 10 shown in FIGS. 3–5, that the header 66 serve as an inlet header that receives the high pressure refrigerant flow from the system 12 and distributes the high pressure of refrigerant flow to the tubes 40A–C, the header 68 serves as an exit header that collects the high pressure refrigerant from the tubes 40A–C and delivers it back to the system 12, the header 74 serves as an inlet header that receives the low pressure refrigerant flow and distributes it to the tubes 42A–C and the header 76 serves as an exit header that collects the low pressure refrigerant flow from the tubes 42A–C and delivers it back to the system 12.

It should be understood that the number of tubes 40 and 42 and the number of tube runs for each of the tubes 40 and 42 will be highly dependent upon the specific parameters of each particular application for the heat exchanger 10. Such parameters, for example, could include the amount of fluid flow anticipated through each of the flow paths 20, 30 of the heat exchanger 10, the type of fluid for each of the flow paths 20, 30 of the heat exchanger 10, the desired effectiveness of the heat exchanger 10, the materials of the heat exchanger tubes 40, 42, 40A–C, 42A–C, and the working pressure of the fluids for the heat exchanger 10. In this regard, if there are an odd number of tube runs in one of the tubes 40, 42, 40A–C, 42A–C, the headers for that tube will be at opposite ends of the heat exchanger, whereas for an even number of tube runs, the headers will be at the same end of the heat exchanger 10.

While flattened heat exchange tubes are highly preferred, it is possible that in some specific applications heat exchange tubes having other cross sectional shapes may prove to be desirable.

Additionally, it should also be understood that while cylindrical headers are preferred, there may be some applications where other header designs and cross-sections may be desirable.

It should be understood that one possible advantage of the disclosed heat exchanger 10 is ease of manufacture. More specifically, a simple automatic folding process can make the main body of the heat exchanger 10, i.e. the tubes. The tubes would preferably be clad with braze material or a braze foil with be added on the flat sides 44 where they abut each other. Additionally, because the internal diameter of the headers 66, 68, 74, and 76 need only accommodate the minor dimension of the tubes 40, 42, 40A–C, 42A–C, the internal diameter can be made small enough so that the wall thickness of each of the headers needed to withstand the burst pressure required in a $CO_2$ transcritical cooling cycle becomes such that the headers can be pierced to form the openings for the tubes.

We claim:

1. A heat exchanger for transferring heat between first and second fluid flows, the heat exchanger comprising:

a plurality of flattened, first heat exchange tubes to direct the first fluid flow through the heat exchanger, each first tube including at least a first pair of substantially parallel, spaced tube runs connected by a bend in the first tube, the first pairs of tube runs being substantially aligned with each other;

a plurality of flattened, second heat exchange tubes to direct the second fluid flow through the heat exchanger, each second tube including at least a second pair of substantially parallel, spaced tube runs connected by a bend in the second tube, the second pairs of tube runs being substantially aligned with each other and substantially perpendicular to the first pairs of tube runs;

one of the tube runs of each of the second tubes being sandwiched between the tube runs of each first pair of tube runs of the first tubes, and one of the tube runs of each of the first tubes being sandwiched between the tube runs of each second pair of tube runs of the second tubes.

2. The heat exchanger of claim 1 further wherein:

each of said second tubes includes an additional tube run substantially parallel to the second pair of tube runs of the second tube and connected to said one of the tube runs of the second tube by an additional bend; and the other one of the tube runs of each of the first tubes is sandwiched between the additional tube run of each of the second tubes and said one of the tube runs of each of the second tubes.

3. The heat exchanger of claim 1 further comprising:

a first pair of manifolds connected to opposite ends of each of the first tubes to collect the first fluid from and distribute the first fluid to the first tubes; and a second pair of manifolds connected to opposite ends of each of the second tubes to collect the second fluid from and distribute the second fluid to the second tubes.

4. A heat exchanger for transferring heat between first and second fluid flows, the heat exchanger comprising:

a plurality of first heat exchange tubes to direct the first fluid flow through the heat exchanger, each first tube including at least a first pair of substantially parallel, spaced tube runs connected by a bend in the first tube, the first pairs of tube runs being substantially aligned with each other;

a plurality of second heat exchange tubes to direct the second fluid flow through the heat exchanger, each second tube including at least three substantially parallel, spaced tube runs connected by bends in the second tube, the tube runs of each of the second tubes being substantially aligned with the tube runs of the other of the second tubes and substantially perpendicular to the first pairs of tube runs;

one of the tube runs of each of the second tubes being sandwiched between the tube runs of each first pair of tube runs of the first tubes;

one of the tube runs of each of the first tubes being sandwiched between said one of the tube runs of each of the second tubes and another of the tube runs of each of the second tubes; and the other of the tube runs of each of the first tubes being sandwiched between another of the tube runs of each of the second tubes and said one of the tube runs of each of the second tubes.

5. The heat exchanger of claim 4 further wherein each of the first and second tubes is a flattened tube.

6. The heat exchanger of claim 4 further comprising:

a first pair of manifolds connected to opposite ends of each of the first tubes to collect the first fluid from and distribute the first fluid to the first tubes; and a second pair of manifolds connected to opposite ends of each of the second tubes to collect the second fluid from and distribute the second fluid to the second tubes.

7. A heat exchanger for use in a transcritical cooling system including a compressor, a gas cooler that receives a high pressure refrigerant flow from the compressor and delivers a cooled high pressure refrigerant to the system, an expansion device that receives the high pressure refrigerant flow from the gas cooler and delivers a low pressure refrigerant flow to the system, and an evaporator that receives the low pressure refrigerant flow and delivers heated low pressure refrigerant to the system, the heat exchanger comprising:

a first inlet manifold adapted to receive the high pressure refrigerant flow from the system;

a plurality of flattened, first heat exchange tubes connected to the first inlet manifold to receive the high pressure refrigerant therefrom, each first tube including at least a first pair of substantially parallel, spaced tube runs connected by a bend in the first tube, the first pairs of tube runs being substantially aligned with each other;

a first outlet manifold connected to the first tubes to collect the high pressure refrigerant flow therefrom;

a second inlet manifold adapted to receive the low pressure refrigerant flow from the system;

a plurality of flattened, second heat exchange tubes to direct the second fluid through the heat exchanger, each second tube including at least a second pair of substantially parallel, spaced tube runs connected by a bend in the second tube, the second pairs of tube runs being substantially aligned with each other and substantially perpendicular to the first pairs of tube runs; and a second outlet manifold connected to the second tubes to collect the low pressure refrigerant flow therefrom; wherein one of the tube runs of each of the second tubes is sandwiched between the tube runs of each first pair of tube runs of the first tubes, and one of the tube runs of each of the first tubes is sandwiched between the tube runs of each second pair of tube runs of the second tube.

8. The heat exchanger of claim 7 further wherein:

each of said second tubes includes an additional tube run substantially parallel to the second pair of tube runs of the second tube and connected to said one of the tube runs of the second tube by an additional bend; and the other one of the tube runs of each of the first tubes is sandwiched between the additional tube run of each of the second tubes and said one of the tube runs of each of the second tubes.

* * * * *